US005609719A

United States Patent [19]

Hempel

[11] Patent Number: 5,609,719

[45] Date of Patent: Mar. 11, 1997

[54] METHOD FOR PERFORMING CHEMICAL MECHANICAL POLISH (CMP) OF A WAFER

[75] Inventor: Eugene O. Hempel, Garland, Tex.

[73] Assignee: Texas Instruments Incorporated, Dallas, Tex.

[21] Appl. No.: 333,674

[22] Filed: Nov. 3, 1994

[51] Int. Cl.[6] ..... B24B 1/00

[52] U.S. Cl. ..... 156/636.1

[58] Field of Search ..... 156/636.1, 645.1; 451/41, 287, 288, 527, 550

[56] References Cited

U.S. PATENT DOCUMENTS

| | | | |
|---|---|---|---|
| 5,020,283 | 6/1991 | Tuttle | 451/550 |
| 5,078,801 | 1/1992 | Malik | 134/7 X |
| 5,216,843 | 6/1993 | Breivogel et al. | 451/287 X |
| 5,297,364 | 3/1994 | Tuttle | 451/527 |
| 5,329,734 | 7/1994 | Yu | 451/41 |
| 5,394,655 | 3/1995 | Allen et al. | 451/41 X |
| 5,441,598 | 8/1995 | Yu et al. | 156/645.1 |

*Primary Examiner*—Thi Dang

*Attorney, Agent, or Firm*—Paul C. Hashim; Wade James Brady; Richard L. Donaldson

[57] ABSTRACT

A CMP pad (58) for polishing a semiconductor wafer includes flat polymer sheet (85) for adhering to platen (26). Flat polymer sheet (85) receives slurry (66) that lubricates pad (58) and semiconductor wafer (54) as they contact one another. Pad (58) includes slurry recesses (82) that hold slurry (66) and a plurality of slurry channel paths (66) that form flow connections between predetermined ones of slurry recesses (82). Pad (58) maintains a desired level of slurry (66) between semiconductor wafer (54) and pad (58) to increase the oxide layer removal rate from semiconductor wafer (54), make the semiconductor wafer (54) surface more uniform, and minimize edge exclusion (92) in the CMP of semiconductor wafers (54).

9 Claims, 5 Drawing Sheets

OXIDE LAYER = 15.5K

| WAFER | MIN | MAX | MEAN | RANGE | STDV | %STD | AMOUNT REMOVED | % NON-UNIFORMITY |
|---|---|---|---|---|---|---|---|---|
| 1-P | 1106.2 | 4812.0 | 3336.1 | 3705.8 | 1044.4 | 31.3 | 12164 | 8.5 |
| 2-C | 5852.4 | 8514.6 | 7227.4 | 2662.2 | 857.02 | 11.8 | 8273 | 10.3 |
| 3-P | 3279.6 | 6542.0 | 4905.3 | 3262.4 | 1038.7 | 21.1 | 10595 | 9.7 |
| 4-C | 5280.9 | 7922.4 | 6716.7 | 2641.5 | 786.20 | 11.7 | 8784 | 8.9 |
| 5-P | 5.619 | 3065.7 | 1471.2 | 3060.1 | 987.49 | 67.1 | 14029 | 7.0 |
| 6-C | 1419.7 | 5616.3 | 3554.8 | 4196.6 | 1414.6 | 39.7 | 11946 | 11.8 |
| 7-P | 4859.2 | 7448.3 | 6302.5 | 2589.1 | 767.39 | 12.1 | 9198 | 8.3 |
| 8-C | 7258.5 | 9682.5 | 8546.3 | 2424.0 | 755.44 | 8.83 | 6954 | 10.8 |
| 9-P | 4.651 | 3671.2 | 1789.6 | 3666.5 | 1259.9 | 70.4 | 13711 | 9.1 |
| 10-C | 1383.0 | 4753.9 | 3173.5 | 3370.9 | 1164.7 | 36.7 | 12327 | 9.4 |
| 11-P | 5426.2 | 7669.0 | 6610.9 | 2242.8 | 718.09 | 10.8 | 8890 | 8.1 |
| 12-C | 7344.2 | 9348.1 | 8411.3 | 2003.9 | 678.31 | 8.06 | 7039 | 9.6 |

AVERAGE REMOVAL: 11,431 PER WAFER WITH
9,220 PER WAFER WITHOUT

AVERAGE NON-UNIFORMITY: 8.45% WITH
10.13% WITHOUT

METHOD FOR PERFORMING CHEMICAL MECHANICAL POLISH (CMP) OF A WAFER

TECHNICAL FIELD OF THE INVENTION

The present invention relates to a method and system for fabricating an electronic device and, more particularly, to a method, apparatus, and system for performing a chemical mechanical polish (CMP) of a semiconductor wafer that includes an improved CMP polishing pad.

BACKGROUND OF THE INVENTION

Before the dawn of the half-submicron age, a wafer's surface flatness was a topical issue, though not an overriding one. Now, as the number of metal layers of a wafer are increasing, planarity becomes critical dimension. Today, with 0.35 micron features becoming widespread, surface planarity is assuming new importance, since it offers the key to boosting circuit performance.

Chemical mechanical polishing (CMP) is a process for improving the surface planarity of a semiconductor wafer and involves the use of mechanical pad polishing systems usually with a silica-based slurry. CMP offers a practical approach to achieving the important advantage of global wafer planarity.

However, CMP systems for global planarization have certain limitations. These limitations include low wafer throughput, polished surface non-uniformity, and a problem related to polishing uniformity known as "edge exclusion." Edge exclusion occurs when too much of the semiconductor wafer surface is polished. This causes the edge or outer portion of the wafer to be not useable for integrated circuit fabrication. Wafer polish throughput and polish uniformity are important process parameters, because they also directly affect the number of integrated circuit chips that a fabrication facility can produce per unit equipment for a given period of time.

SUMMARY OF THE INVENTION

Therefore, a need has arisen for an improved method and apparatus for performing CMP of a semiconductor wafer that increases oxide layer removal rate relative to existing methods and apparatus.

There is a further need for a CMP pad that provides more uniform polishing across the semiconductor wafer.

There is yet a further need for a CMP pad and method for using the pad that minimizes edge exclusion in the polished semiconductor wafer.

In accordance with the present invention, an improved CMP pad and method for using the CMP pad are provided that substantially eliminate or reduce disadvantages and problems associated with previously developed CMP polishing pads and methods.

More specifically, the present invention provides an improved pad for CMP polishing of a semiconductor wafer that includes a flat polymer sheet for adhering to a polishing platen of a CMP system. The polymer sheet receives a slurry that lubricates and mildly abrades a semiconductor wafer as it comes in contact with the pad. The pad has a plurality of slurry recesses for holding slurry in the pad and further includes a plurality of slurry channel paths for forming flow connections between certain ones and perhaps all of the slurry recesses for maintaining a coating of slurry between the wafer and the pad.

Another aspect of the present invention is a method for polishing a semiconductor wafer that includes the steps of placing the semiconductor wafer on a carrier device. The method includes the steps coating the slurry on a pad to a thickness that is sufficient to cover the pad. The pad has a plurality of slurry recesses and a plurality of channel paths that connect between the slurry recesses. The slurry is coated on the pad to a sufficient thickness to fill the slurry channel paths and the slurry recesses. The method further includes the step of moving the semiconductor wafer relative to the pad for performing the wafer CMP.

A technical advantage of the present invention is that it increases the oxide layer removal rate over that of conventional CMP processes.

Another technical advantage that the present invention provides is that it reduces nonuniformities that exist on semiconductor wafers polished by conventional methods.

Yet another technical advantage of the present invention is that it limits edge exclusion compared to that which occurs on a semiconductor wafer polished by known processes.

Still another technical advantage of the present invention is it forms a simple modification to a variety of existing polishing pads and through the modification significantly improves the CMP process for semiconductor wafers.

BRIEF DESCRIPTION OF THE DRAWINGS

For a more complete understanding of the present invention and the advantages thereof, reference is now made to the following description which is to be taken in conjunction with the accompanying drawings in which like reference numerals indicate like features and wherein.

DETAILED DESCRIPTION OF ILLUSTRATIVE EMBODIMENTS

Preferred embodiments of the present invention are illustrated in the FIGUREs, like numerals being used to refer to like and corresponding parts of the various drawings.

Figure 1:
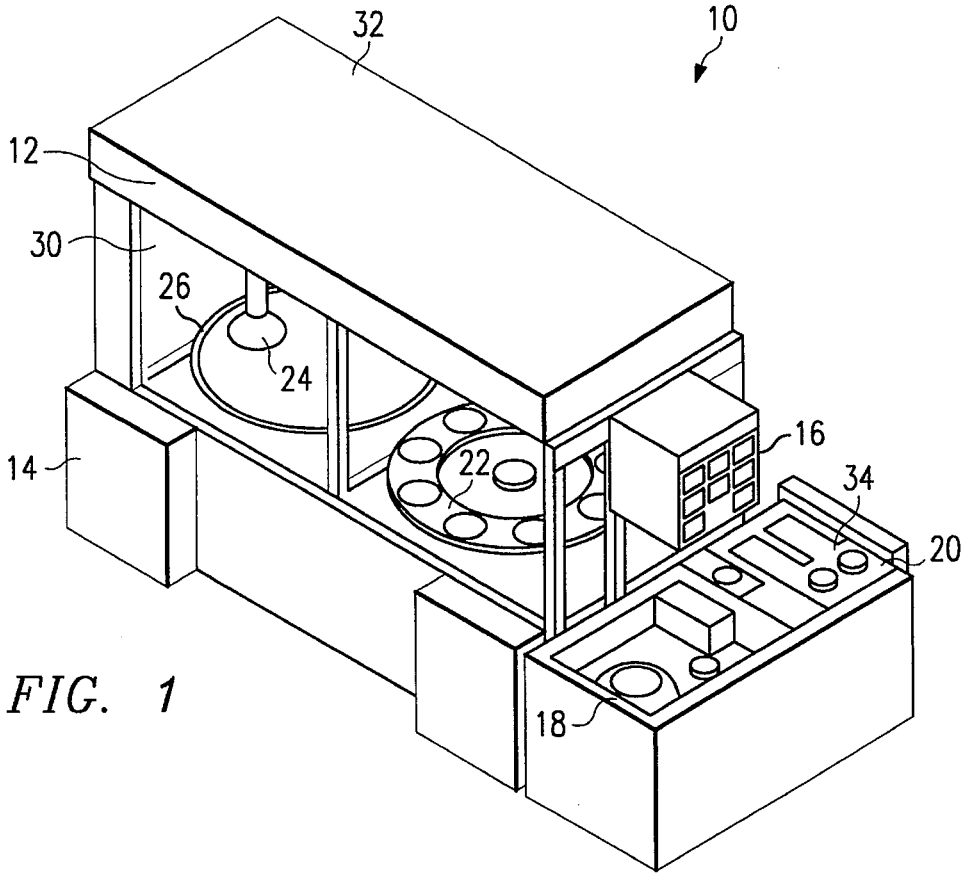
FIG. 1 provides an isometric view of a CMP system that may employ the present embodiment of the invention.

FIG. 1 shows chemical mechanical polish CMP system 10 that may use the present embodiment of the invention. CMP system includes cabinet 12 on frame 14. Attaching to cabinet 12 is touch screen interface 16. Input module 18 and output cassette 20 associate with cabinet 12 for supplying and receiving semiconductor wafers. Frame 14 includes necessary cabinets and access panels for the mechanical and electrical components within cabinet 12, input module 18 and output cassette 20. Cabinet 12 establishes a clean environment in which semiconductor wafers may be transferred to index table 22 which rotates to make accessible a semiconductor wafer to carrier device 24. Carrier device 24 picks up the semiconductor wafer from index table 22 and places it in contact with pad 26 which contacts polishing plate 28. Access doors 30 and filter arrangement 32 isolate cleaning operation within cabinet 12 from the external environment. Input module 18 provides semiconductor wafers to index table 22. Output water track 34 and output cassette 20 work together to receive semiconductor wafers from index table 22 and store these wafers in a deionized water bath.

Figure 2:
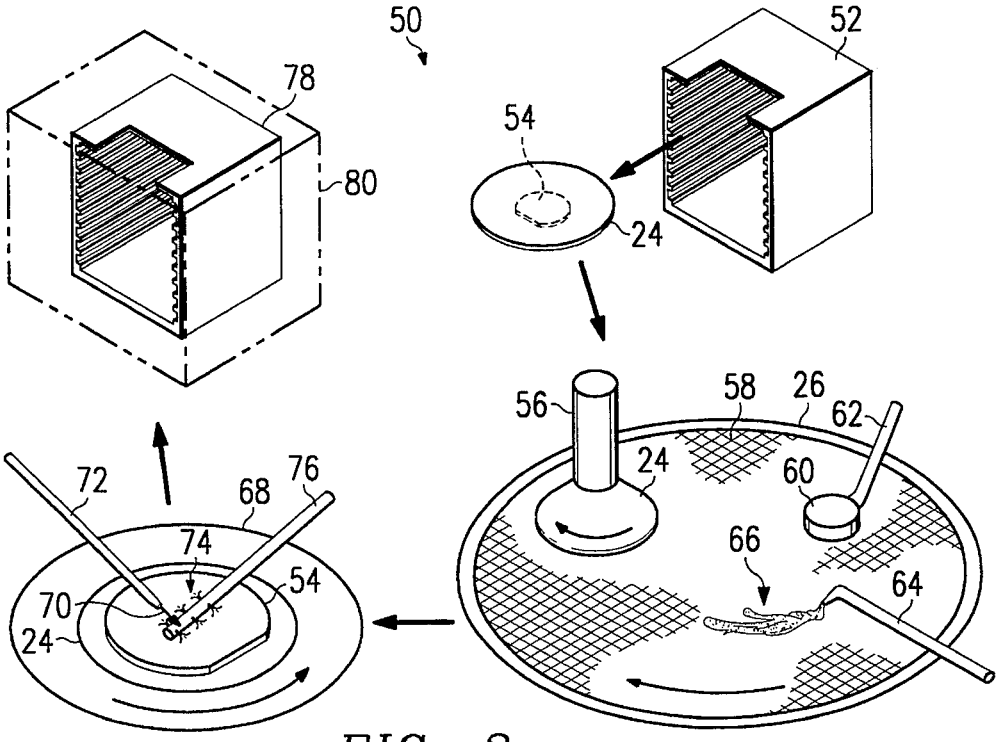
FIG. 2 conceptually depicts the process of the present embodiment.

FIG. 2 shows in more detail the process that CMP system 10 performs for the purpose of identifying the intended use of the present embodiment employs. Referring to FIG. 2, input cassette 52 holds numerous semiconductor wafers 54 that carrier device 24 removes and holds in place by a vacuum force. Robotic arm 56 moves carrier device 24 close to pad 58 which attaches to polishing platen 26. End effector 60 attaches to robotic arm 62 to condition polishing pad 58. Through applicator 64, slurry 66 is applied to polishing pad 58. By rotating carrier device 24 and contacting polishing pad 58, semiconductor wafer 54 is conditioned in the CMP process of the present embodiment.

Following the CMP polish step, the present embodiment may include a step of removing the slurry from semiconductor wafer 54. In FIG. 2, cleaning station 68 receives semiconductor wafer 54 which continues to attach to carrier device 24. Carrier device 24 and semiconductor wafer 54 rotate at a speed of approximately 100 rpm while a combination of jet sprayed water 70 from spray applicator 72 sprays through PH controlling mist 74 from applicator 76. U.S. patent application Ser. No. 08/298,808 entitled "Method and System for Chemical Mechanical Polishing of Semiconductor Wafers" filed 31 Aug. 1994 describes in more detail the pH controlling aspects here described (hereinafter Hempel). Hempel is herein incorporated by reference. In process 50 of FIG. 2, after it is cleaned semiconductor wafer 54 is transferred to output cassette 78 which is totally submersed in a deionized water bath 80 to prevent wafer 54 contamination.

Figure 3:
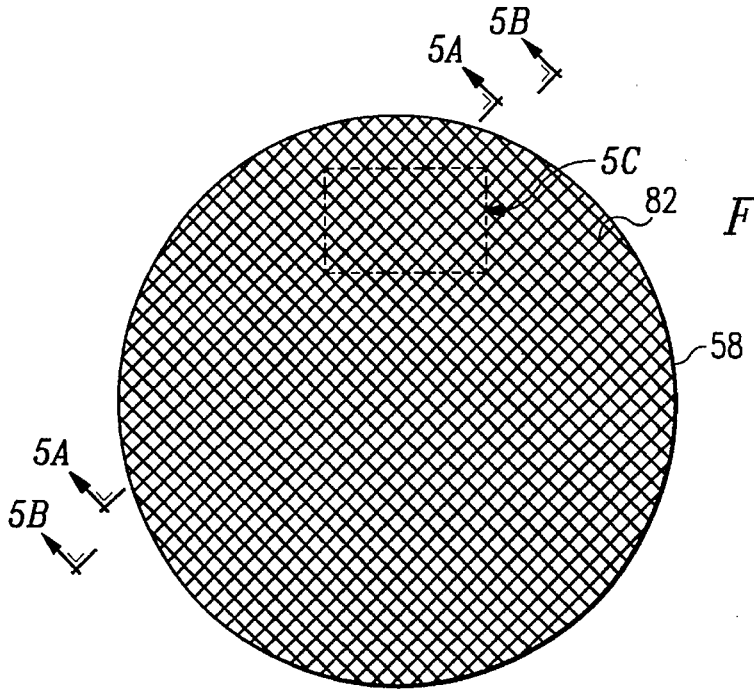
FIG. 3 shows a face view of the CMP pad of the present embodiment.

FIG. 3 illustrates the present embodiment of the invention which includes polishing pad 58 on which are placed numerous slurry recesses 82. Certain of the slurry recesses 82 are connected via channels 84. Channels 84 permit slurry 66 that is placed on polishing pad 58 to communicate from one slurry recess 82 to another. This maintains a desired level of slurry on polishing pad 58 as semiconductor 54 comes in contact with the slurry 66 on polishing pad 58.

Figure 4:
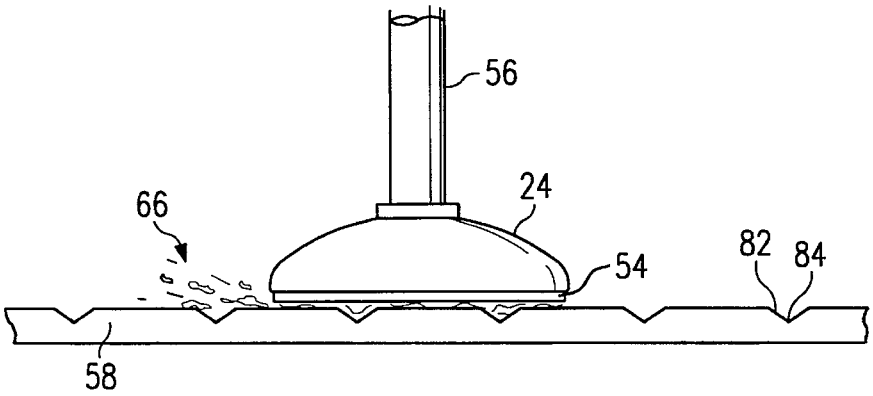
FIG. 4 describes operation of the present embodiment for polishing a semiconductor wafer.
Figure 5A:
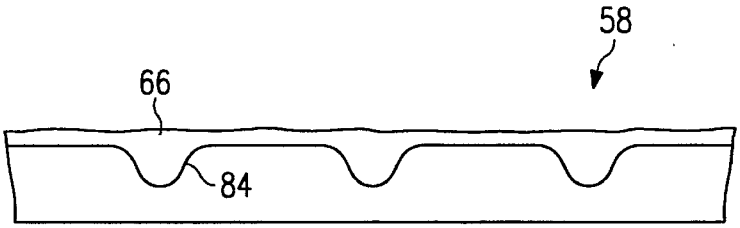
FIGS. 5*a*, 5*b*, and 5*c* show more detailed aspects of the CMP pad of FIG. 4.
Figure 5B:
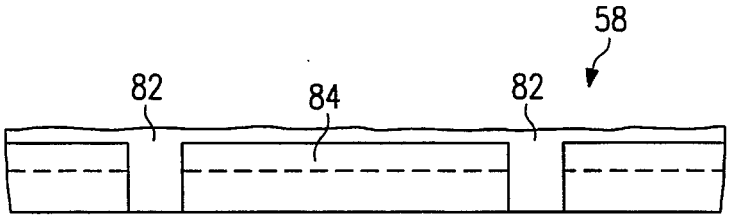
Figure 5C:
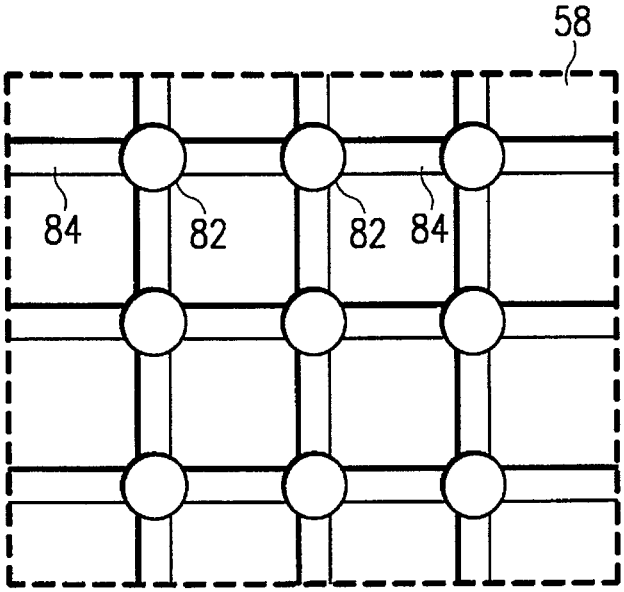

FIG. 4 shows carrier device 24 which robotic arm 56 moves so that semiconductor wafer 54 contacts slurry 66 which is deposited on polishing pad 58. To maintain a desired level of slurry on polishing pad 58, slurry channel pads 84 and slurry recesses 82 contain slurry 66.

FIGS. *5a*, *5b*, and *5c* show in more detail the configuration of channel paths 84 in association with the slurry recesses 82 of the present embodiment. In particular, FIG. *5a* shows polishing pad 58 to include numerous slurry channels 84 for containing slurry 66. FIG. *5b* shows an aspect of pad 58 that is perpendicular to that of FIG. *5a* to indicate the approximate depth of slurry channels 84. FIG. *5b* also indicates how slurry channels 84 connect between slurry recesses 82 to more evenly distribute slurry over polishing pad 58. FIG. *5c* shows in more detail the path configuration that slurry channels 84 form between slurry recesses 82. As can be seen in FIG. *5c*, the combination of slurry channels 84 with slurry recesses 82 form a network of paths that hold slurry 66 and permit slurry 66 to communicate across the surface of polishing pad 58. This more uniformly distributes slurry 66 and improves the CMP process that the present embodiment performs.

Figure 6:
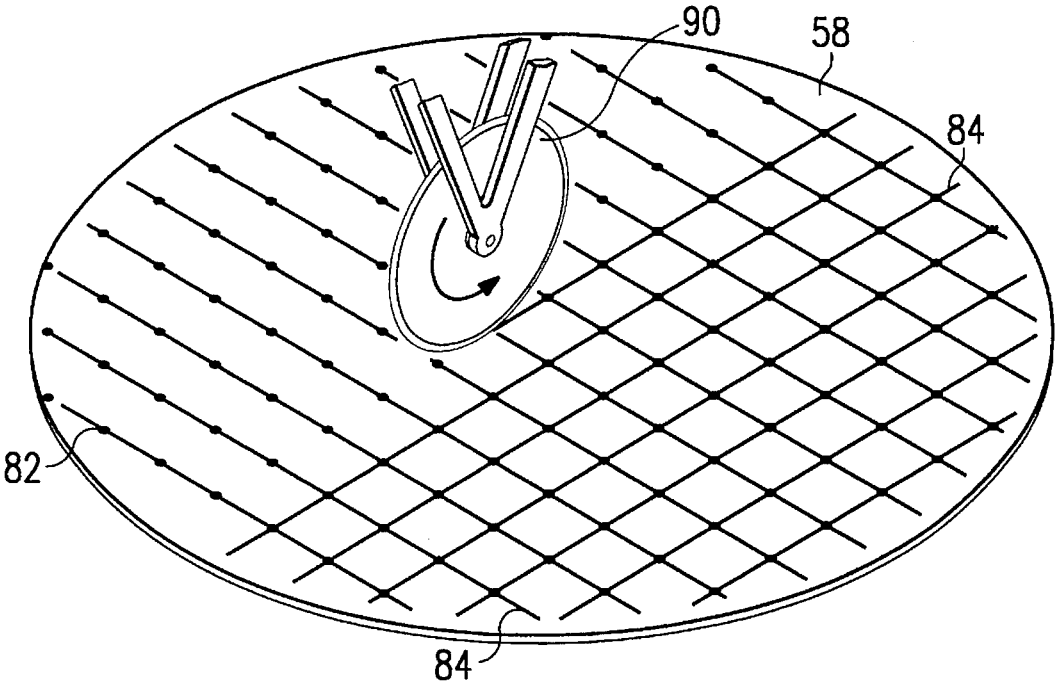
FIG. 6 illustrates a method of forming the CMP pad of the present embodiment.

FIG. 6 shows a method of forming slurry channels 84 on polishing pad 58. By using high precision cutting wheel 90, for example, it is possible to make the desired cuts within polishing pad 58. In the present embodiment, channel paths 84 are cut along lines that intersect slurry recesses 82. Due to the alignment of slurry recesses 82, slurry channels 84 intersect with one another at 90° angles. In the event that slurry recesses 82 are orientated differently, the angle between intersecting slurry channels 84 may be more or less than 90°.

Cutting wheel 90 of FIG. 6 may be a precision saw having a thickness of 25 to 50 mils. For this purpose, each slurry channel 84 may have a width of 25 to 50 mils and a depth of 25 to 50 mils.

Figures 7, 8:
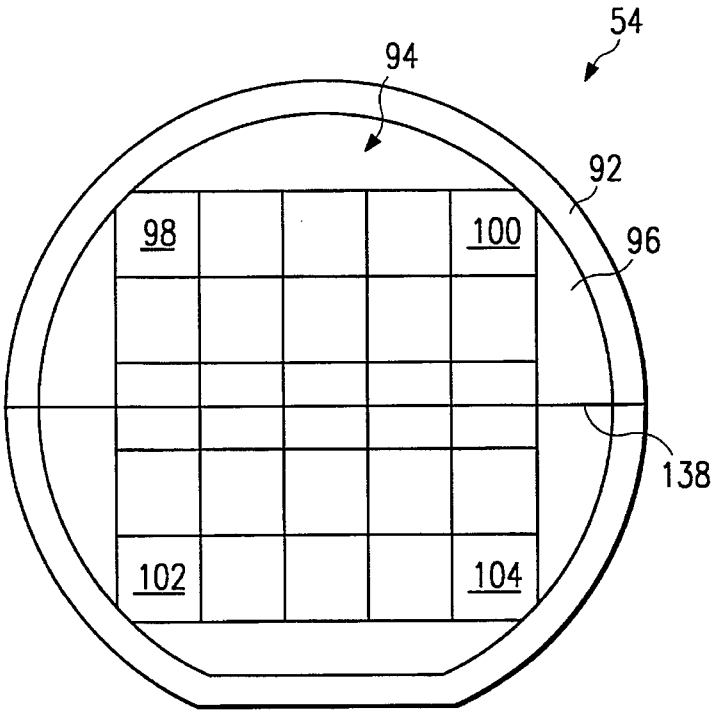
FIG. 7 shows a table of results to illustrate the achievements of the present embodiment.
FIGS. 8 and 9 depict edge exclusion properties of a semiconductor wafer polish with and without the present embodiment of the invention.

FIG. 7 shows a table of measurements that illustrate the results that the present embodiment achieves. In particular, the table of FIG. 7 shows 12 semiconductor wafers, some of which are polished using the polishing pad of the present embodiment (i.e., wafers numbered 1-P, 3-P, 5-P, 7-P, 9-P, and 11-P), and others to which (i.e., wafers 2-C, 4-C, 6-C, 8-C, 10-C, and 12C) that are polished using a conventional chemical mechanical polishing pad that does not include slurry channels 84. Each of the wafers in the table of FIG. 7 began with an additional oxide layer of 15,500 Å. The values of the FIG. 7 table under the "MIN," "MAX," "MEAN," "RANGE," "STDV," are, respectively, minimum, maximum, mean, variation range, and standard deviations for a set of 49 measurement points on each of the process taken with reference to the oxide layer remaining on the semiconductor wafer. The "AMOUNT REMOVED" column is derived from subtracting the quantity in the "MEAN" column from the value 15,500 Å and indicates the amount of oxide removed from the semiconductor wafer. The "% STD" column indicates the percent that the standard deviation of the oxide layer thickness across the wafer represents of the mean value for the oxide layer. The "% NONUNIFORMITY" column indicates the percent that the standard deviation represents of the amount removed for each wafer in the FIG. 7 table.

The FIG. 7 table also includes an average amount removed for the semiconductor wafers polished with pad 58 including slurry channels 84 and wafers polished for the same amount of time using polishing pad 58 that, except for slurry channels 84, it has the same characteristics as polishing pad 58. That is, the average removal for wafers 54 using pad 58 of the present embodiment is 11,431 Å. Without pad 58, but with a conventional polishing pad, the removal is 9,220 Å for the same period of time. As can be seen, therefore, the average amount removed for the wafers using pad 58 with slurry channels 84 for the same amount of time is over 2,000 Å greater than without slurry channels 84. In addition, the average in percent non-uniformity for the wafers using a pad 58 with slurry channels 84 is 8.45%, compared with an average percent non-uniformity of 10.13% for those wafers with a pad not having slurry channels 84. In essence, therefore, the present embodiment invention substantially increases not only the oxide removal rate for semiconductor wafers, but also generally decreases the non-uniformity of the semiconductor wafer 54 surface.

Figure 9:
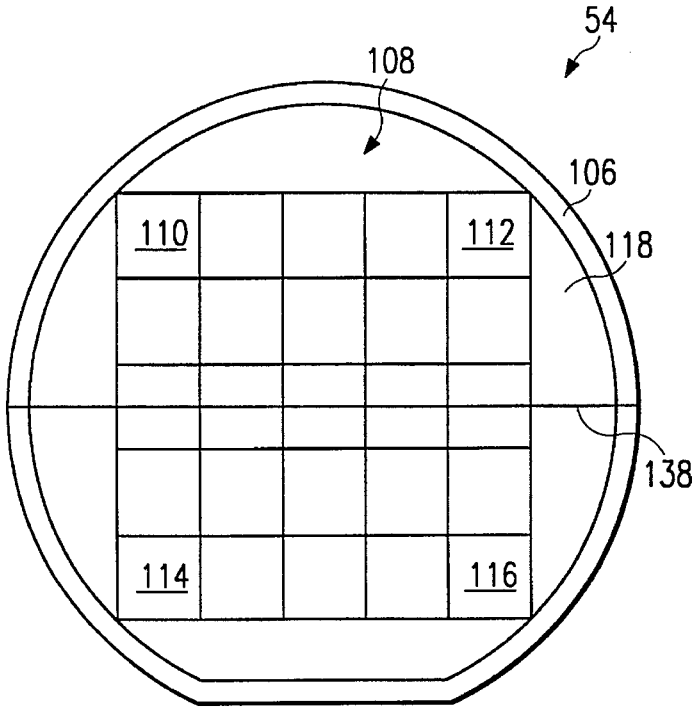
Figure 10:
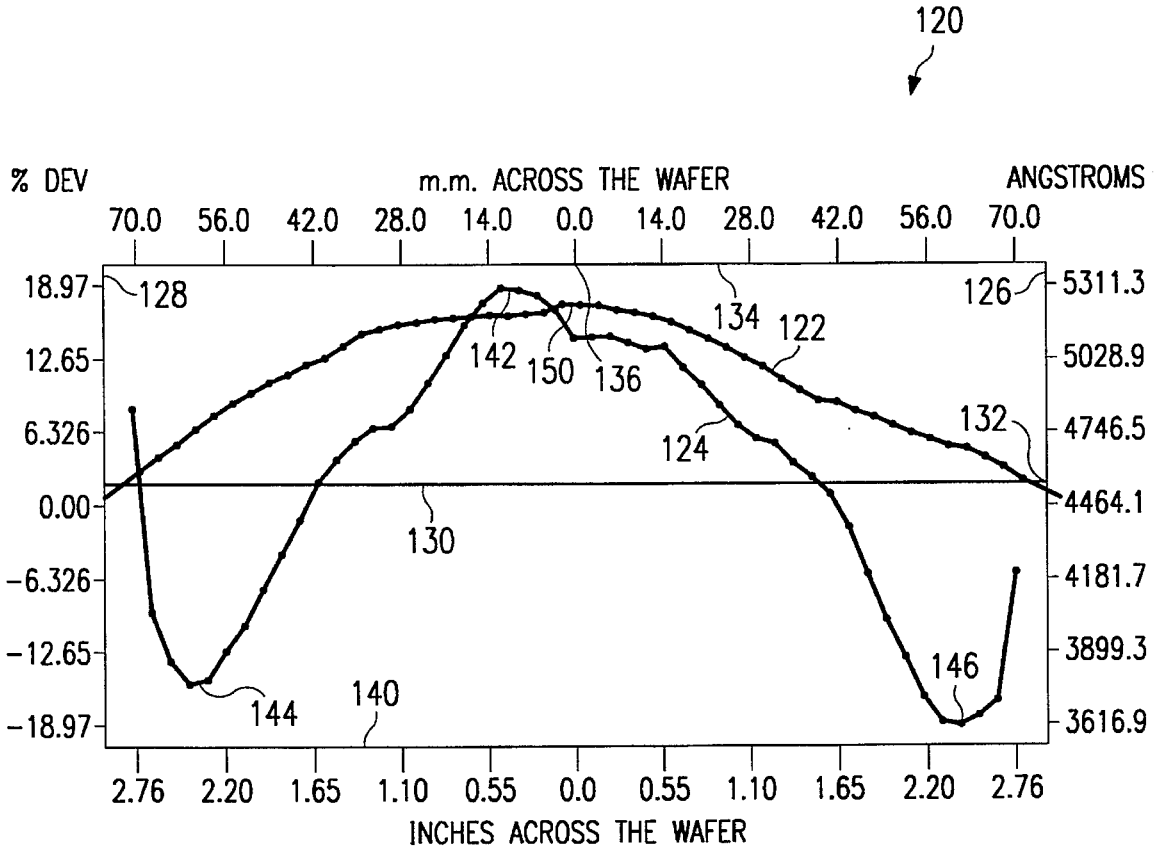
FIG. 10 provides a plot of semiconductor wafers polished with and without the present embodiment.

FIGS. 8, 9, and 10 illustrate the reduction of edge exclusion that the present embodiment achieves. For example, FIG. 8 shows semiconductor wafer 54 which includes perimeter 92 that forms in the conventional CMP process. The width of perimeter 92 significantly effects the ability to include integrated circuits on semiconductor wafer 54. For example, integrated circuit 94 is formed on area 96 of semiconductor wafer 54. As can be seen, in the integrated circuit pattern 94, integrated circuits 98, 100, 102, and 104 cannot be used because they fall, at least in part, within perimeter 92. Perimeter 92 forms an edge which excludes the acceptable fabrication of integrated circuits. This phenomenon, known as "edge exclusion," can be minimized by minimizing the width of perimeter 92.

The present embodiment of the invention minimizes edge exclusion on semiconductor wafer 54, as shown in FIG. 9. In FIG. 9, semiconductor wafer 54 has a smaller perimeter 106. As such, integrated circuit die 108, having the same surface area as integrated circuit die 94 of FIG. 8, includes the corners of integrated circuits dies 110, 112, 114, and 116. This make integrated circuits 110, 112, 114, and 116 now. By minimizing the edge exclusion on semiconductor wafer 54, the yield of integrated circuits from the wafer increases.

FIG. 10 shows test results that indicate the thickness across semiconductor wafer 54 of the oxide layer to indicate how the present embodiment achieves minimal edge exclusion. In particular, plot 120 of FIG. 10 includes line 122 which is typical of the results obtained using the present embodiment. Line 124 is typical of the results obtained with conventional processes. Vertical axis 126 records the thickness of the oxide layer on semiconductor wafer 54. Along vertical axis 128 is a percent deviation calculation from line 130 which may be, for example, a desired oxide level thickness indicated at point 132 on axis 126. Horizontal axis 134 indicates the position of an oxide layer thickness measurement from the center of wafer 54 at point 136 to the left and to the right of axis 136.

The measurements of plot 120 of FIG. 10 are taken at the diameter 138 of FIGS. 8 and 9, above, for example. Axis 140 of FIG. 10 indicates measurements in inches across the wafer along diameter 138, for example. As line 124, indicates the greatest thickness of wafer 54 appears approximately at point 142 which is near the center of semiconductor wafer 54. Moving both to the left and to the right, the layer thickness decreases to the value that axis 126 indicates at line 132. Thereafter, moving outward from the center of semiconductor wafer 54, the thickness of wafer 54 is least at points 144 and 146. As the oxide layer approaches low points 144 and 146, the usefulness of these areas of semiconductor wafer 54 diminishes. That is, integrated circuits may not be successfully formed in these regions.

Line 122 of plot 120, on the other hand, shows a relative maximum at approximately point 150 and a gradual diminishing of the oxide layer thickness as measurements are taken in the direction of the outer edges of semiconductor wafer 54. Note that the intersection of line 122 with line 130 does not occur until much closer to the edge of semiconductor wafer 54. As such, much more of the area of semiconductor wafer 54 is usable. This increases the integrated circuit yield by minimizing the undesirable edge exclusion.

OPERATION

The above description makes operation of the present embodiment apparent, but the following discussion describes in still further detail how the components and parts cooperate with one another to achieve the technical advantages of the present invention.

CMP pad 58 of the present embodiment may be used with a variety of CMP planarization devices. For example, the following table provides a list of possible CMP systems that may employ the present invention.

TABLE 1

| | CMP Planarization Equipment | | | | |
|---|---|---|---|---|---|
| | Cybeq Systems | Fujikoshi | SpeedFam Corp. | R. Howard Strasbaugh Inc. | Westech Systems Inc. |
| Model number/ Name | 3900 | 2PD-200 | CMP V Planarization System | 6DS-SP | 372 |
| Minimum/maximum wafer size | 100–300 mm | 150–200 mm | 150–200 mm | 75–200 mm | 125–200 mm |
| Type of wafer handling | Robotics | Vacuum chuck (automated) | Cassette-to-cassette | Robot feed cassette-to-cassette | Cassette-to-cassette |
| Polishing force range/accuracy (lbs) | 30–1000 | N.A. | 0–500 lbs ± 2 lbs | 0–500 lbs ± 2 lbs | 0–500 lbs ± 1 lb |
| Number of slurry systems | 2 | User defined | 2 | 2 | up to 4 |
| Slurry flow range in ml/min | 300–32,000 | 0–500 | 0–1000 | 0–1000 | 25–500 or 50–1000 |
| Conditioning speed | 1–30 rpm | Adjustable | Programmed | Programmed | Programmed |
| Conditioning cycles | Programmed | 5 step | Programmed | Programmed | Programmed |
| Number of wafers/cycle | 6 | 2 | 5 | 2 | 1 |
| Removable rate/ TEOS (Å/min) | 1000 | 100–1000 | 1000–3000 | 1000–3000 | up to 4000 |
| Weight | 6000 lbs | 5500 lbs | 13,000 lbs | 8500 lbs | 6800 lbs |

Variables in the process of the present embodiment include polish pad 58, the down force with which carrier 24 applies semiconductor wafer 54 to pad 58, the back pressure from pad 58, the amount of pressure that robotic arm 60 applies to condition pad 58, and the amount of polish toning used to polish semiconductor wafer 54. Pad 58 may be, for example, formed for the cellular structured material similar to that of a Rodel IC 1000 pad to which carrier 24 applies a constant down force of eight pounds per square inch. The back pressure from pad 58 may be four pounds per square inch constant. A force of five pounds may be applied by robotic arm 60 to condition pad 58. The platen 26 revolution rate may be 18 revolutions per minute polish time for each semiconductor wafer 54 is four to six minutes. With this process, a removal rate increase of 20% to 25% may be achieved with better uniformity and minimize edge exclusion. Regarding the edge exclusion, a standard of 10 millimeters across the wafer diameter (i.e., a perimeter 92 width of five millimeters) is achievable using conventional chemical mechanical polishing processes. The present embodiment, however, reduces edge exclusion to between six and seven millimeters across the wafer 58 diameter.

ALTERNATIVE EMBODIMENTS

In summary, the present invention provides an improved for CMP and for polishing a semiconductor wafer and method for using the pad for a CMP process that includes a flat polymer sheet for adhering to a polishing platen of a CMP system. The polymer sheet receives a slurry that lubricates and mildly abrades a semiconductor wafer as it comes in contact with the pad. The pad has a plurality of slurry recesses for holding slurry in the pad and further includes a plurality of slurry channel paths for forming flow connections between certain ones and perhaps all of the slurry recesses for maintaining a coating of slurry between the wafer and the pad.

Although the invention has been described in detail herein with reference to the illustrative embodiments, it is to be understood that this description is by way of example only and is not to be construed in a limiting sense. It is to be further understood, therefore, that numerous changes in the details of the embodiments of the invention and additional embodiments of the invention, will be apparent to, and may be made by, persons of ordinary skill in the art having reference to this description. It is contemplated that all such changes and additional embodiments are within the spirit and true scope of the invention as claimed below.

What is claimed is:

1. A method for polishing a semiconductor wafer, comprising the steps off:

placing the semiconductor wafer on a carrier device;

coating a slurry on a pad to a predetermined thickness, the pad having a plurality of channel paths and a plurality of slurry recesses at intersections of certain ones of the plurality of channel paths, said recesses having a depth greater than that of said channel paths to facilitate slurry collection and retention in said recesses, the slurry thickness being sufficient to fill the slurry recesses and flow through the channel paths;

imparting relative motion to said semiconductor wafer and to said pad;

contacting the semiconductor wafer with the pad for polishing the semiconductor wafer, while maintaining a sufficient layer of the slurry on the pad for lubricating the semiconductor wafer.

2. The method of claim 1, further comprising the step of rotating the carrier device in a first circular direction and rotating the pad in a second circular direction opposite the first circular direction.

3. The method of claim 1, further comprising the step of maintaining a sufficient coating of slurry on the pad for extending the polishing area of the semiconductor wafer and thereby reducing edge exclusion on the semiconductor wafer by flowing slurry through the channel paths at the periphery of the semiconductor wafer.

4. The method of claim 1, further comprising the step of flowing the slurry through the channel paths for maintaining a sufficiently uniform layer of slurry on the pad for uniformly polishing the semiconductor wafer to a thickness variation of less than 8 mils between any two points on the surface of the semiconductor wafer.

5. The method of claim 1, further comprising the step of flowing the slurry through the channel paths to maintain a prescribed amount of slurry on the pads to increase an oxide layer removal rate from the semiconductor wafer.

6. The method of claim 1, further comprising the step of flowing the slurry through a channel path, such that each of the slurry recesses associates with at least one of the plurality of channel paths.

7. The method of claim 1, further comprising the step of cleaning the slurry from the semiconductor wafer using a pH controlling bath at a semiconductor wafer cleaning station.

8. The method of claim 1, wherein said contacting step comprises the step of contacting the rotating semiconductor wafer with a pad having a cellular material structure for polishing the semiconductor wafer while maintaining a sufficient layer of the slurry on the pad for lubricating the semiconductor wafer.

9. The method of claim 1, wherein said coating step further comprises the step of flowing the slurry through a plurality of channel paths connecting between certain ones of the plurality of slurry recesses, the channel paths having a width of not greater than about 50 mils and a depth of not greater than about 50 mils for maintaining the slurry on the pad.

* * * * *